United States Patent [19]

Stewart

[11] 4,257,385

[45] Mar. 24, 1981

[54] ARCHERY BOW WITH THUMB RECEIVING OPENING

[75] Inventor: William R. Stewart, Gainesville, Fla.

[73] Assignee: Victor United, Inc., Chicago, Ill.

[21] Appl. No.: 102,877

[22] Filed: Dec. 12, 1979

[51] Int. Cl.[3] ..... F41B 5/00

[52] U.S. Cl. ..... 124/24 R; 124/88

[58] Field of Search ..... 124/23 R, 24 R, 41 A, 124/88, 86, 22

[56] References Cited

U.S. PATENT DOCUMENTS

| | | | |
|---|---|---|---|
| 736,051 | 8/1903 | Adams | 124/24 R |
| 2,125,591 | 8/1938 | Smith | 124/24 R |
| 2,507,271 | 5/1950 | Ringel | 124/24 R |

*Primary Examiner*—William R. Browne

*Attorney, Agent, or Firm*—Emory L. Groff, Jr.

[57] ABSTRACT

An archery bow includes a handle including a primary section having a sight window segment extending inwardly well beyond the bow center line. Additional strength and resistance to twisting of the bow limbs attached to the handle is provided by a supplemental handle section affixed to the inside surface of the primary handle sight window segment as well as to the inside handle surface in an area well below the sight window. A completely peripherally enclosed thumb opening extends horizontally through the handle intermediate the two sections to provide, along with a grip portion of the primary handle section, a comfortable and positive grasp of the bow during its draw and release.

11 Claims, 8 Drawing Figures

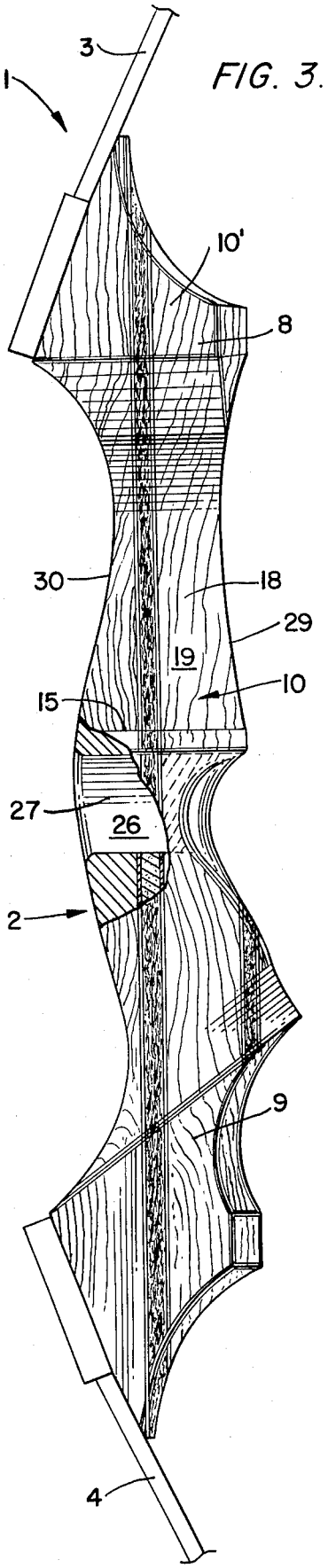
FIG. 3.
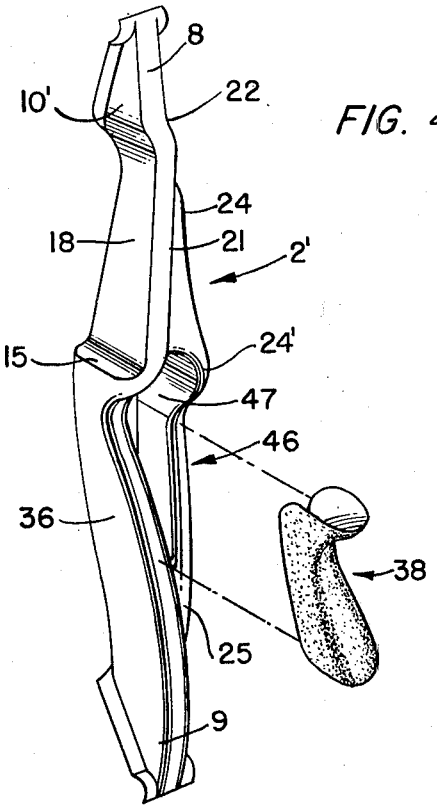
FIG. 4.
FIG. 5.
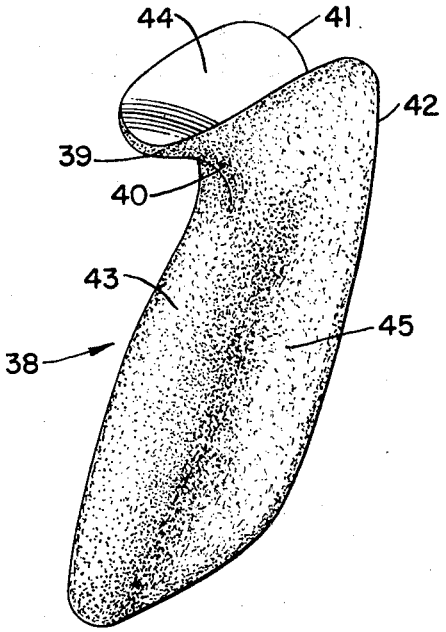

ARCHERY BOW WITH THUMB RECEIVING OPENING

This invention relates generally to an archery device and more particularly, to an improved handle for an archery bow whether constructed of wood, reinforced plastic composition or metal.

The bow handle of the present invention is constructed to provide a greatly enlarged sight window that is, the transverse dimension of the relief or cut-out area which receives, supports and guides the arrow shaft and its fletching, extends inwardly from the outside surface of the handle a greater distance than that normally encountered. More particularly, the open face of the handle section, in the area of the sight window is disposed in a vertical plane well inside of the center line of the bow as determined by the vertical axis bisecting the two bow limbs and passing through to the handle section. This construction will be understood to enhance the release of an arrow since it places the plane of the bow string along a vertical line not crowded by the open face of the sight window segment of the handle.

The disposition of a bow handle sight window extending laterally beyond the center line axis of a bow is well known in this art particularly since the advent of the now popular compound bow. As is well known, the vertical plane of a bow string in a compound bow is transversely displaced during the draw and release of such a bow due to the disposition of the bow string grooves in the eccentric pulleys at the ends of the bow limbs. Thus, with certain compound bows, a greater than normal over-center disposition of the sight window would be a decided asset since the plane of the bow string will deviate to either side of the bow center line during its use. Until the present invention, the over center disposition of the bow sight window has been limited by the requirement to maintain sufficient rigidity or strength in the bow handle section so as to minimize the chance of breakage of the handle and limb and twisting or deflection of the bow limbs during use.

By the present invention, an even greater enlarged sight window is provided while the necessary strength and rigidity is achieved by the use of a supplemental handle section rigidly affixed to a primary handle section, the latter of which forms the handle sight window and hand grip. A substantially horizontally extending thumb opening is formed between the primary and supplemental handle sections and is disposed for the most part below the level of the sight window so as to cooperate with the handle grip portion to provide a most comfortable and positive grasp of the bow by the archer.

When the present invention is practiced with a metal bow handle the width or thickness of the stock employed may understandably be less than that utilized in the case of wood or plastic laminates and accordingly, it is proposed that the grip portion of a metal bow handle be constructed, in combination with a cooperating supplemental section, so as not only provide the aforementioned thumb opening but also to accommodate interchangeable hand grip adapters such as shown in the patent to Bear, U.S. Pat. No. 3,415,241 dated Dec. 10, 1968 and assigned to the Assignee of this invention.

Accordingly, one of the objects of the present invention is to provide an improved archery bow handle including a vertical segment defining a sight window extending well past the center line of the bow and which cooperates with a rigidly attached supplemental section extending downwardly to a point well below the sight window.

Another object of the present invention is to provide an improved archery bow handle including a sight window extending well beyond the center line of the bow and which is disposed atop a grip portion having a thumb opening adjacent thereto and which is disposed entirely beyond the center line of the bow.

A further object of the present invention is to provide an improved archery bow handle of laminated wood and/or plastic construction having a primary handle section providing a sight window extending substantially past the center axis of the bow and to which is attached a supplemental handle section with both handle sections defining portions of thumb segments forming a thumb hole therethrough.

Still another object of the present invention is to provide an improved archery bow handle of metal construction including a primary section having a sight window extending well past the center line of the bow and disposed atop a grip portion with a supplemental handle section affixed to the primary section and spanning the grip portion to provide a thumb opening therebetween.

Another object of the present invention is to provide an improved archery bow handle of metal construction including a sight window extending well past the center line of the bow and disposed atop a grip portion bounded on one side by a supplemental handle section spaced therefrom to allow for the interchangable attachment of an adapter about the grip portion as well as for the insertion of the archer's thumb between the adapter and supplemental handle section.

With these and other objects in view which will more readily appear as the nature of the invention is better understood, the invention consists in the novel construction, combination and arrangement of parts hereinafter more fully described, illustrated and claimed.

FIG. 3 is a left side elevation, with portions in section, of the handle of FIG. 2;

FIG. 4 is a front perspective view of a modification of the bow handle of the present invention;

FIG. 5 is an enlarged perspective view of the hand grip adapter useable with the handle of FIG. 4;

Similar reference characters designate corresponding parts throughout the several figures of the drawings.

Figure 1:
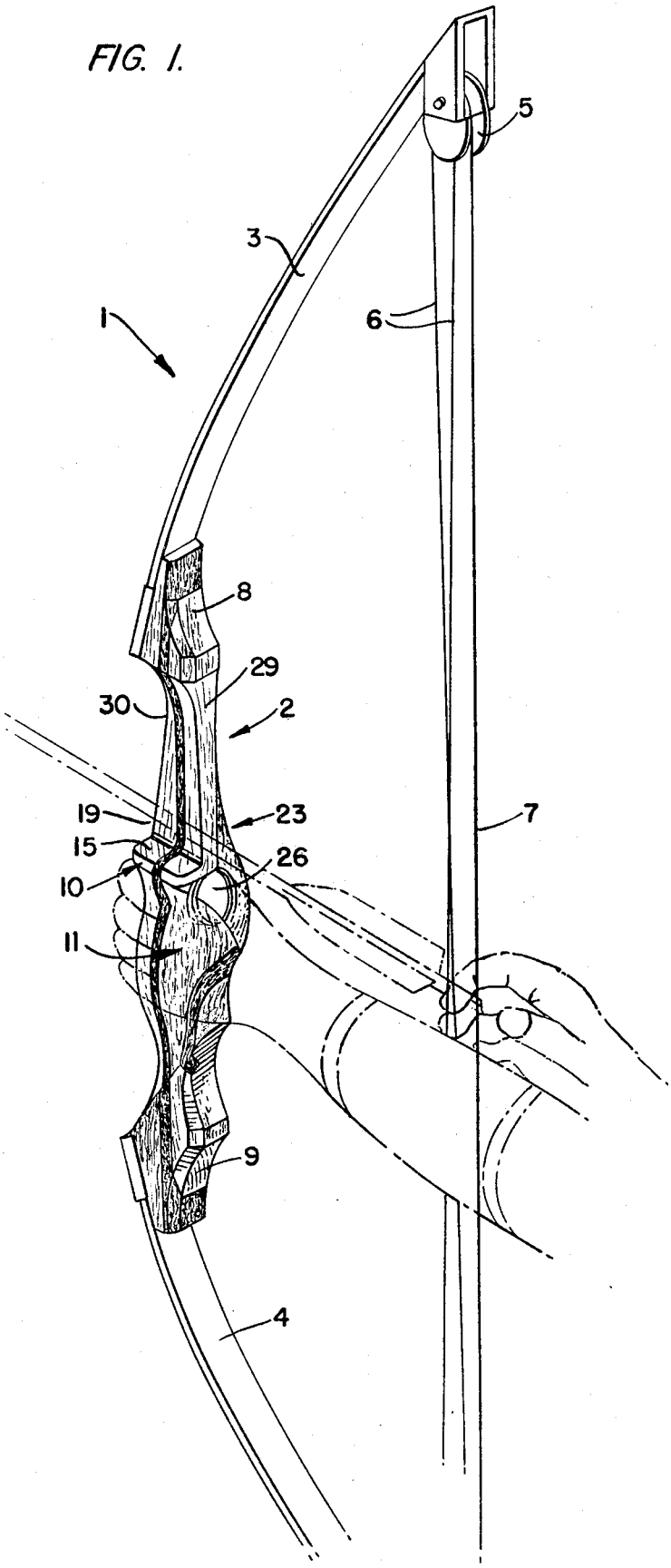
FIG. 1 is a partial perspective view of an archery bow including the handle of the present invention.

Referring now to the drawings, particularly FIG. 1, the present invention will be seen to relate to an archery bow, generally designated 1, having a central handle 2 joined to an upper limb 3 and lower limb 4 respectively. The illustrated bow 1 depicts a typical compound bow having well known features including the eccentric pulleys 5 mounted at the distal portions of the two limbs and about which are sheaved pulley cables 6 and a bow string 7. The crux of the present invention revolves about the construction of the handle 2 and this handle may be combined with any suitable flexible limbs 3 and 4 with or without the compound bow features such as the eccentric pulleys 5 and it is not intended to restrict the instant invention to any specific limb confiquration or method of attachment of the inner ends of the selected flexible limbs 3–4 to the upper portion 8 or lower portion 9 of the handle 2. Thus, it will follow that the bow limbs may comprise integral extensions of the material forming the handle 2 or alternatively, may be separate elements either permanently affixed to the handle such as by glue or, removably attached thereto by any one of the various methods well known to those skilled in this art. From the above it will also be understood that when the handle is employed in a compound bow, the location and manner of attachment of the pulleys may be other than as shown in the drawings. As an example, it is well known to include alternate pulleys attached to a bow handle.

Figure 2:
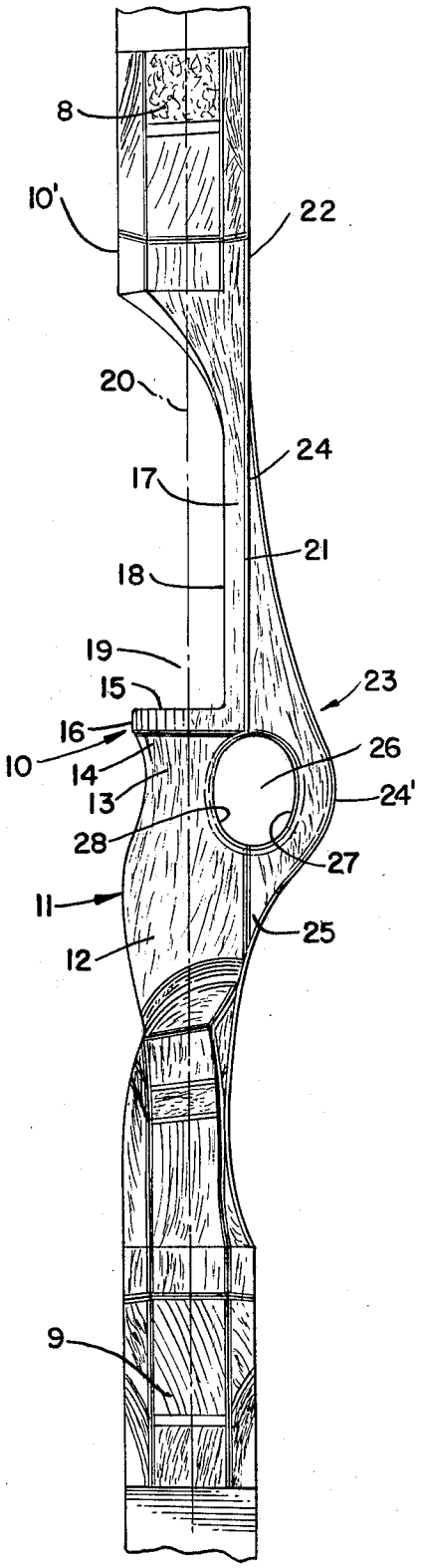
FIG. 2 is an enlarged front elevation of the handle shown in FIG. 1.

In the embodiment illustrated in FIGS. 1–3 of the drawings, the handle 2 is shown to reflect a construction comprising a plurality of laminations of wood selected, arranged and assembled to provide a substantially rigid component exhibiting relatively little flexure during use of the associated bow 1. This handle includes a primary handle section 10 having an outside surface 10' and includes a grip portion 11 disposed above the lower portion 9 and which is preferably configured to provide comfortable engagement with the palm and fingers of the archer.

In the case of wood or laminated reinforced plastic construction, it will be appreciated that such sculptured configuration may be readily achieved during manufacture of the handle 2 and accordingly, the grip 11 preferably comprises an enlarged lower area 12 disposed beneath a reduced neck portion 13 and which in turn is bounded at its top by the enlarged horn portion 14. The top of this horn portion terminates in a substantially flat horizontal arrow rest or shelf 15 extending inwardly from its outer edge 16 a sufficient distance to overlie substantially the entire grip portion 11 as shown most clearly in FIG. 2 of the drawings. The primary handle section 10 further includes a vertically extending sight window handle segment 17 having an open face 18 preferably extending several inches above the arrow shelf 15 before curving outwardly to join the handle upper portion 8. The thus described arrow shelf 15 and vertical handle segment 17 will be understood to define the sight window 19 through which the archer views his target as an arrow is placed upon the shelf 15 prior to and during the draw and release of the bow string 7.

An important feature of the present invention is that the described sight window 19 encompasses a lateral extent through the bow handle 2 which is substantially greater than that normally provided and this construction will be seen, particularly from the illustration of FIG. 2, to be formed by the location of the open face 18 of the sight window handle segment 17 in a vertical plane disposed well beyond the bow center line as depicted at 20. Normally, such a construction as above described, with the inside surface 21 of the primary handle section sight window handle segment 17 disposed co-planar with the outside surface 22 of the handle upper portion 8, would result in a lateral thickness for the sight window handle segment 17 which would be dangerously thin. It will be appreciated that with such a minimal thickness in the area of the primary handle section which is laterally adjacent the sight window 19, that insufficient strength and rigidity would be present to adequately resist unwanted twisting or deflection of the handle upper and lower portions 8–9 and additionally, the limbs 3–4 during use of the bow.

Accordingly, the present invention proposes the inclusion of the supplemental handle secton 23 suitably fixedly attached to the right hand side surface 22 of the handle 2 such as by use of an appropriate adhesive. This supplemental section 23 includes a top portion 24 attached to the inside surface 21 of the sight window handle segment 17 and which extends downwardly to a maximum laterally offset portion or maximum enlargement 24' located in an area beneath the plane of the arrow rest 15. The supplemental section 23 further extends downwardly to a bottom portion 25 secured to the grip 11 of the primary handle section or any point therebelow.

The grip portion 11 and maximum enlargement 24' of the two handle sections cooperate to define a substantially horizontally disposed thumb hole or opening 26 therethrough which from FIG. 2 of the drawings will be seen to be defined by a curved thumb segment 27 inside the supplemental handle section and a curved thumb segment 28 formed adjacent the neck portion 13 of the primary handle section grip 11.

The thus described construction will be understood to result in an asymmetrical handle when viewed from either the front 29 or back 30 of the bow handle 2 and includes an integral construction having a substantial mass of rigid material formed by the supplemental handle section 23 and located beyond the plane of the outside surface 22 as well as beyond the primary handle section sight window handle segment 17. The archer grasps the bow as shown in FIG. 1 of the drawings, with the enlarged lower area 12 of the grip saddled within the palm of the hand while the four fingers are wrapped about one side of the grip and the thumb is disposed through the opening 26 thereby resulting in an extremely natural, comfortable and positive grasp of the bow either while it is being carried or while being drawn and released.

As previously mentioned, the bow handle of the present invention may be constructed of metal. FIGS. 4, 6–8 illustrate a modified bow handle 2' formed of such material. In this embodiment the same components exist with respect to the primary handle section 35 as in the first described embodiment with the exception of the grip portion 36. With a metal construction it will be appreciated that adequate rigidity and resistance to flexure may be achieved in the area of the grip without the necessity of constructing this portion of the handle with a heavy enlarged lower area as in the area 12 of the first described handle. Thus, the entire grip portion 36 of the primary handle section 35 may comprise a substantially constant cross-section of material resulting in a weight-saving factor and comprising a relatively narrow, elongated cross-section as shown at 37 in FIG. 8 of the drawings. Inasmuch as such an elongated construction would result in an extremely uncomfortable grip for the archer it is proposed that the grip portion 36 be combined with an interchangable hand grip adapter as shown in FIG. 5 of the drawings.

Figure 6:
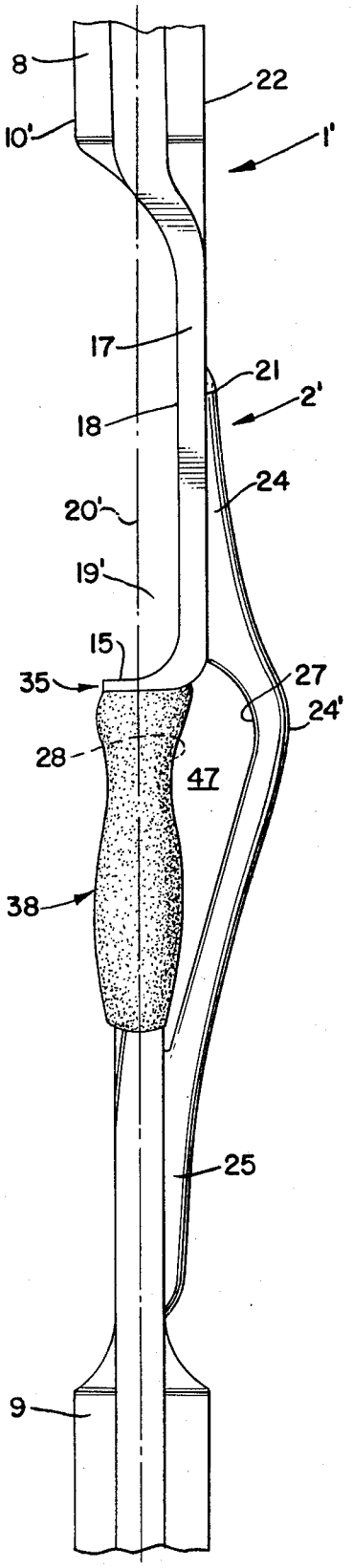
FIG. 6 is a front elevation of the handle of FIG. 4.
Figure 7:
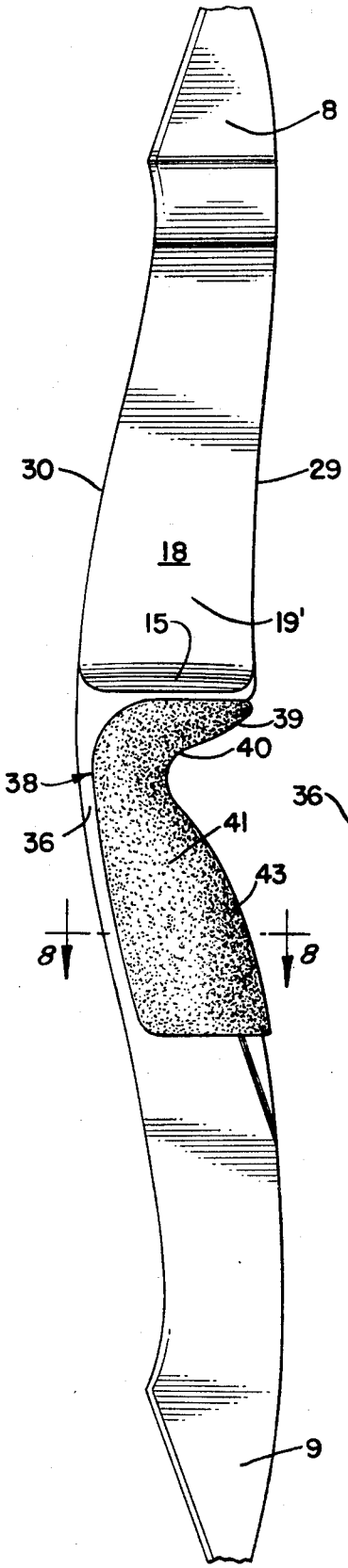
FIG. 7 is a left side elevation of the handle of FIG. 6.
Figure 8:
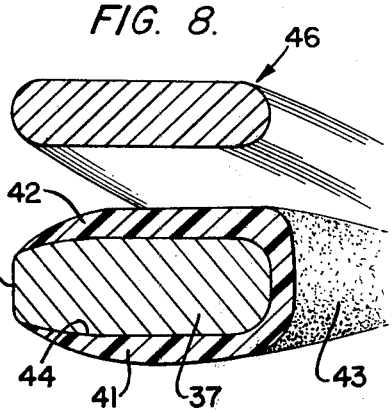
FIG. 8 is a horizontal sectional view taken along the line 8—8 of FIG. 7.

This adapter 38 includes a horn 39 at its upper portion joined to a reduced neck portion 40 and includes a pair of side walls 41–42 extending forwardly from a common mid-wall 43 such that a vertically disposed interior channel 44 is provided which channel provides a tight mating fit about the grip portion 36 of the bow handle primary section 35. To achieve such a removable fit the adapter is preferably constructed of a suitable composition possessing at least a limited degree of resilience, such as synthetic rubber or plastic to insure a snug engagement of the handle grip portion 36. The exterior 45 of the hand grip adapter 38 quite obviously may be of any suitable configuration and therefore various thicknessess may exist between this exterior and the relatively constant dimension of the interior channel 44 so that the most comfortable and natural grasp of the bow 1' will exist when the archer grasps the bow with the adapter 38 in position as shown in FIGS. 6–7 of the drawings.

As the first described embodiment, the sight window handle segment 17 of the handle 2' extends substantially beyond the bow longitudinal center line 20' to insure a sight window 19' that extends well inwardly of the center line 20' and accordingly, the lateral thickness of the sight window segment 17 is necessarily minimal in view of the disposition of the inside surface 21 in a co-planar relationship with the outside surface 22 of the upper handle portion 8. Therefore, a supplemental handle section 46 is again provided and includes a top portion 24 suitably affixed to the sight window handle segment 17 and joined to the laterally extending maximum enlargement portion 24' situated below the horizontal plane of the arrow shelf 15 and which thereafter extends further downwardly to be attached to the lower portion 9 of the handle primary section at a point beneath the grip portion 36. In order to provide for the attachment and removal of the hand grip adapter 38, the resultant thumb hole or opening 47 will necessarily define a greater vertical extent than the circular or oval thumb opening 26 shown in the first described embodiment. Nevertheless, the provision of the supplemental handle section 46 with a top portion 24 affixed adjacent the sight window handle segment 17 and an integral bottom portion 27 affixed to the primary handle section at a point well below the arrow shelf 15 serves to provide the required rigidity necessary to discourage twisting or deflection of the upper and lower portions of the handle as well as any limbs attached thereto.

From the above it will be seen that an improved bow handle is provided which offers a comfortable grasp for the archer and provides a sight window extending laterally a substantial distance past the bow center line. A completely peripherally enclosed thumb receiving opening is formed by a supplemental handle section projecting well beyond the normal handle outside surface and which adds substantial reinforcement to the handle.

I claim:

1. In an archery bow having a pair of limbs the improvement comprising, a handle including upper and lower portions connected respectively to said limbs, said handle having an arrow shelf joined to a vertical segment to define a sight window through said handle, said vertical handle segment provided with an open face disposed laterally of the plane formed by the bow handle, bow limb longitudinal center line and a bow string with said sight window correspondingly extending substantially laterally of said plane, said handle upper and lower portions having an outside surface on its side opposite that of said sight window, and a supplemental handle section on said handle having an enlargement projecting substantially perpendicular to and laterally of the plane of said handle outside surface and including a thumb opening between said enlargement and the balance of said handle and usable when the handle section is gripped by a user.

2. An archery bow handle according to claim 1 wherein, said handle includes a primary section containing said upper and lower portions, vertical segment and arrow shelf, and said primary handle section includes a grip portion beneath said arrow shelf and adjacent said thumb opening.

3. An archery bow handle according to claim 1 wherein, said handle comprises an integral unit constructed of laminated material.

4. An archery bow handle according to claim 1 wherein, said handle comprises an integral unit constructed of metal.

5. An archery bow handle according to claim 1 wherein, said vertical segment includes an inside face substantially co-planar with said outside surface, said supplemental handle section having a top portion affixed to said inside face and a bottom portion affixed to said handle beneath said arrow shelf and said thumb opening.

6. An archery bow handle according to claim 1 wherein, said handle includes a grip portion having an enlarged lower area, a reduced dimension neck portion adjacent said thumb opening and an enlarged dimension horn beneath said arrow shelf.

7. An archery bow handle according to claim 2 wherein, said grip portion includes a segment of said thumb opening and said supplemental handle section includes a laterally adjacent segment of said thumb opening.

8. An archery bow handle according to claim 2 including, an interchangeable hand grip adapter of disparate material mounted on said grip portion.

9. An archery bow handle according to claim 2 wherein, said grip portion includes an enlarged lower area, a reduced dimension neck portion adjacent said thumb opening an an enlarged dimension horn beneath said arrow shelf.

10. An archery bow handle according to claim 3 wherein, said material is wood.

11. An archery bow handle according to claim 4 including, a grip portion beneath said arrow shelf, said grip portion encompassed on one side by said thumb opening and of a substantially constant and relatively narrow lateral dimension, and and interchangeable hand grip adapter of disparate material mounted on said grip portion.

* * * * *